US006712191B2

(12) United States Patent
Hand

(10) Patent No.: US 6,712,191 B2
(45) Date of Patent: Mar. 30, 2004

(54) ENHANCED BEZEL FOR CURRENCY ACCEPTOR

(75) Inventor: Peter E. Hand, Las Vegas, NV (US)

(73) Assignee: JCM American Corporation, Las Vegas, NV (US)

( * ) Notice: Subject to any disclaimer, the term of this patent is extended or adjusted under 35 U.S.C. 154(b) by 7 days.

(21) Appl. No.: 09/804,333

(22) Filed: Mar. 12, 2001

(65) Prior Publication Data

US 2002/0125627 A1 Sep. 12, 2002

(51) Int. Cl.[7] ..... G07D 7/00; G07F 1/00
(52) U.S. Cl. ..... 194/344; 194/302; 194/350
(58) Field of Search ..... 194/205–213, 194/302, 344, 350–352; 40/319, 323

(56) References Cited

U.S. PATENT DOCUMENTS 4,503,963 A 3/1985 Steiner et al.
5,113,990 A * 5/1992 Gabrius et al. ..... 194/206
5,222,624 A 6/1993 Burr
5,377,805 A * 1/1995 Ono et al. ..... 194/206
5,467,857 A * 11/1995 Takemoto ..... 194/206
5,544,728 A * 8/1996 Dabrowski ..... 194/206
5,896,974 A * 4/1999 Chang ..... 194/206
5,915,518 A * 6/1999 Hopwood et al. ..... 194/207
5,955,718 A 9/1999 Levasseur et al.
6,435,329 B1 * 8/2002 Amari et al. ..... 194/206

FOREIGN PATENT DOCUMENTS

WO WO 00/11620 3/2000

* cited by examiner

*Primary Examiner*—Dean J. Kramer
(74) *Attorney, Agent, or Firm*—Squire, Sanders & Dempsey, L.L.P.

(57) ABSTRACT

This invention is generally directed to a note or bill acceptor having a bezel adapted to display detailed information about the status of the bill acceptor, and other information related to its operation. The bezel is positioned at the intake slot of the bill acceptor. The bezel employs multiple indicators to visually display information. For example, the enhanced bezel may include indicators to display error conditions such as "note box full" or "transport path jammed" conditions, and other information useful for maintenance and diagnostic purposes. Additional visual indicators may display set up information, such as which denominations the bill validator of the machine is programmed to accept, display prompts or instructions to assist the player, such as a display of the denomination of the last bill accepted, or even simple decorative patterns. The bezel may provide additional status information, such as a jammed transport path or full note box, for use by attendants.

24 Claims, 2 Drawing Sheets

10
16
18
14
12
26
22
20
32

30
26
22
24
36
34
32

ENHANCED BEZEL FOR CURRENCY ACCEPTOR

FIELD OF THE INVENTION

The present invention relates to an enhanced bezel intended for use with a currency or bill acceptor which is to be incorporated into an electronic gaming machine, vending machine, point of sale devices and similar host machines.

BACKGROUND OF THE INVENTION

Bill acceptors are now in widespread use in host machines such as gaming machines, vending machines and point of sale devices. Bill acceptors receive paper currency or notes and, using a validator having both hardware and software components, the received currency or note is scanned with a variety of sensors. The sensor information is analyzed to determine authenticity and denomination of the currency or note. If the note is determined to be authentic, e.g. a United States $1, $5, $10, $20, $50 or $100 bill or other legal tender, the note is transported to a cash box within the bill acceptor for storage. Further, based upon the denomination of the accepted currency or note, a signal is sent from the validator to the host machine's controller or processor to cause the host machine to credit or accumulate a corresponding amount within the machine's credit meter representing the cash value available for purchasing products or wagering. Bill acceptors of this type are known and are discussed for example in U.S. Pat. No. 5,863,039 issued Jan. 26, 1999 to Suzuki.

The use of bill acceptors has given rise to a problem associated with users who believe that they have inserted a bill having a higher value than what the machine provides as credits. For example, the user may believe that he or she has inserted a twenty dollar bill while the machine only provides ten dollars in credit. This problem generally requires the attention of an attendant who may be required to open the machine to show the user the last bill inserted to resolve the dispute. Alternatively, the attendant may have to place the machine into a "diagnostic mode" to allow extraction of the information on the correct denomination of the last inserted bill. These types of activities are both labor intensive and inefficient as the machine is taken out of operation until the issue is resolved.

A bill acceptor generally has a rectangular slot where the note or currency is to be inserted. The location of the rectangular slot may be readily identified by a bezel which, in the context of gaming machines, vending machines or the like, is a structure projecting from the front portion of the bill acceptor below the intake slot. The use of bezels in the gaming machine industry has been limited to providing passive functions. For example, it is known to have bezels with several light emitting devices (LEDs) arranged to flash in a runway sequence to attract the patron's attention and identify where the note is to be inserted. It is also known that bezels with different color LEDs, i.e. green and red, are available to provide an indication of whether the bill acceptor is operational. The status information available from these bezels is, however, very limited, i.e. whether the bill acceptor of the machine is enabled or disabled, and it does not provide any other functional utility.

SUMMARY OF THE INVENTION

The present invention is generally directed to a note or bill acceptor, and-more particularly, to an enhanced bezel positioned at or near the intake slot of the bill acceptor. The enhanced bezel is adapted to display detailed information about the status of the bill acceptor, and other information related to its operation.

The enhanced bezel of the present invention employs multiple indicators to visually display information. For example, the enhanced bezel may include indicators to display error conditions such as "note box full" or "transport path jammed" conditions, and other information useful for maintenance and diagnostic purposes. Additional visual indicators may display set up information, such as which denominations the bill validator of the machine is programmed to accept, display prompts or instructions to assist the player, such as a display of the denomination of the last bill accepted, or even simple decorative patterns.

More specifically, the enhanced bezel may include a display area to provide a visual display of information about the bills, vouchers, script and/or currency (hereinafter, collectively "notes") accepted by the bill acceptor. For example, the display may have a visual depiction or backlighted display to show if the received bill has a $1, $5, $10, $20, $50 or $100 denomination. The display is connected to the bill acceptor's processor which receives information from the note validator which senses the authenticity, denomination, amount and type of the note passing through the bill acceptor and which issues a signal corresponding to the note type to the bill acceptor processor and the host machine's processor for accumulation of credits. The same information can be used to control the display on the enhanced bezel.

Further, the bill acceptor will include a note box provided to receive deposited notes and a transport assembly for transporting notes accepted through the note validator to the note box. The bill acceptor processor controls the transport assembly to direct notes received through the note validator to the note box and detects any interference with the operation of the bill acceptor. The bill acceptor's processor also keeps track of the number of bills sent to the note box for retention. Thus, by connecting the processor to the enhanced bezel, additional status information, such as a jammed transport path or full note box may be visually displayed by the enhanced bezel.

The enhanced bezel display system of the present invention thus provides an easy method of interacting with the user of the machine to provide a verification of the denomination of received notes. The enhanced bezel display system of the present invention also enables the attendant of the machine to quickly retrieve information regarding various operations, including the status of the bill acceptor, without having to interrupt the use of the machine.

DETAILED DESCRIPTION OF THE PREFERRED EMBODIMENTS

Figure 1:
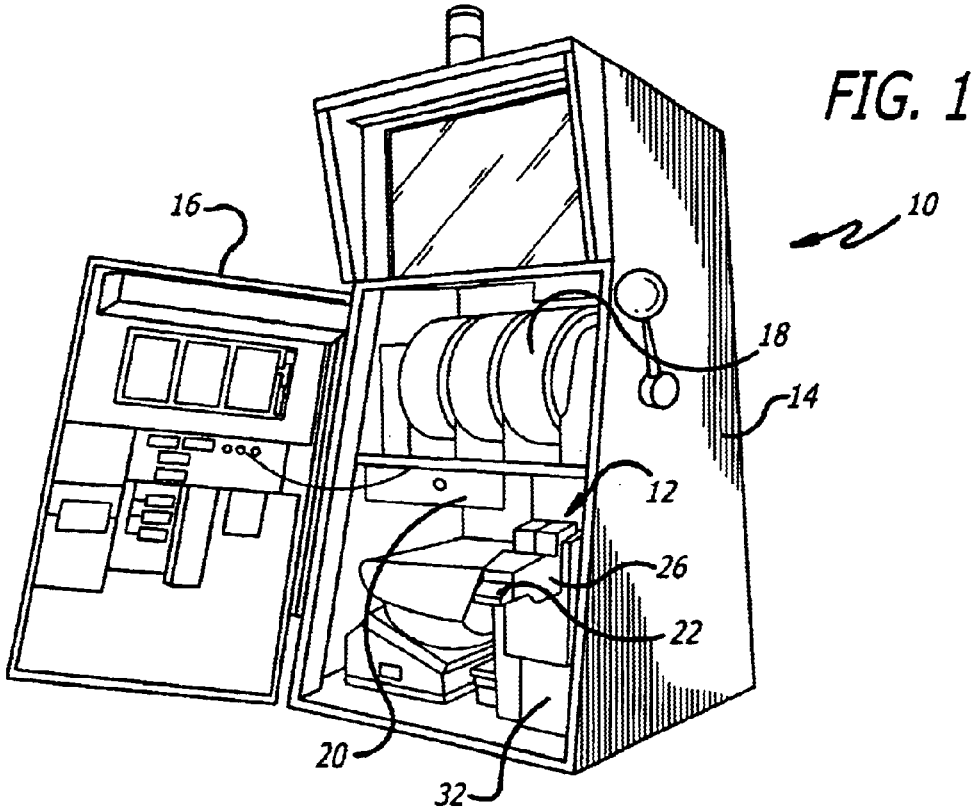
FIG. 1 shows a gaming machine including the bill acceptor having an enhanced bezel according to the present invention.

The present invention can be used in gaming machines, vending machines and pay point machines, where currency or bills are accepted for credits. For purposes of detailing the invention, however, the description herein as shown in FIG. 1, is tailored to the application of the invention in a gaming machine 10. The gaming machine 10 includes a bill acceptor 12 having an enhanced bezel according to the present invention.

The gaming machine 10 generally includes a housing 14 of various potential configurations designed to contain the various components of such machines. The interior of the gaming machine 10 may normally be accessed through opening a front cover or door 16. Disposed within the housing 14 are the reels 18 for the play of the game, a central processing unit (CPU) 20 which controls the operation of the gaming machine 10, as well as a coin hopper assembly adapted to receive, hold and dispense coins or tokens in a known fashion. As is known in the industry, the CPU 20 controls the operation of the gaming machine 10. The CPU 20 controls the selection of the outcome, monitors the amount wagered for each play or "hand," determines winning payouts to the player, monitors the accumulation of credits at the gaming machine available for play and the like. These features, which are controlled by the CPU 20, are now well-known in the art. To monitor the performance and operation, the CPU 20 of each gaming machine 10 in a facility may be in communication with a centralized system server (not shown). The system server monitors the revenue or amounts wagered, amounts paid out and the like for each gaming machine 10 in the facility.

To play a gaming machine 10, a player inserts tokens, coins, bills, currency or script, which are sensed and, if valid, are accumulated as credits for gaming. The received coins or tokens are directed to the coin hopper assembly for storage or the coins/tokens may be directed to an auxiliary collection location, for example under the machine. Alternatively, to amass credits for play of the gaming machine 10, the gaming machine 10 is provided with the bill acceptor 12 having a validator which receives notes as legal tender or script and, based upon the note's value, assigns a corresponding value of credits within the gaming machine 10 for gaming.

Figure 2:
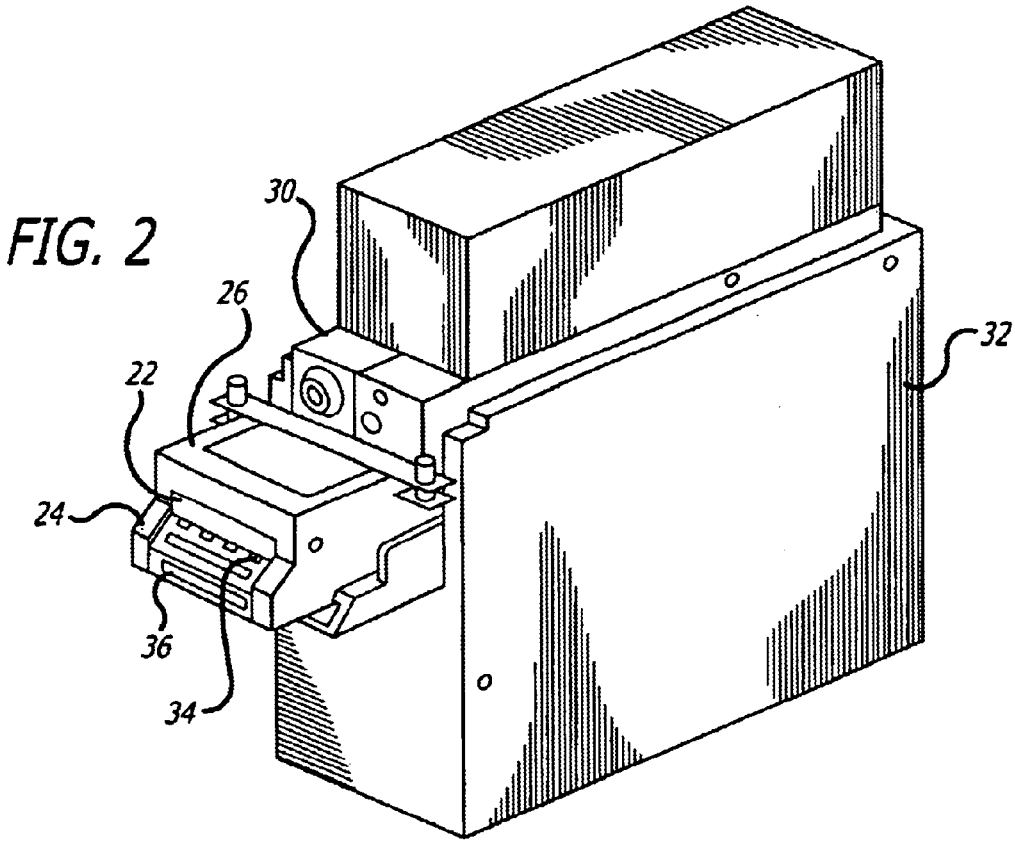
FIG. 2 shows a perspective view of a bill acceptor having the enhanced bezel according to the present invention.

The bill acceptor 12, as shown in FIG. 2, includes a validator 26 adapted to scan a note inserted into a rectangular slot or opening 22 to determine the authenticity, type (legal tender or script, if required), denomination and condition (whether the note is worn) of the note. The enhanced bezel 24 is preferably placed on the front of the bill acceptor 12 and below the opening 22. The enhanced bezel 24 is used as a mechanical interface to the game machine door 16, as it projects to or through an opening in the door 16. The enhanced bezel 24 provides a runway surface 34 immediately befor the opening 22 to allow the patron to easily insert the bill into the bill acceptor 12. The enhanced bezel may also include a display surface 36 vertically mounted at the leading edge of the runway surface 34.

A bill, once inserted over the runway surface 34 and into opening 22, is captured and transported by a transportation unit 30 past optical and magnetic sensors (not shown) which may, for example, sense light reflected by and/or transmitted through the note, reflectivity and transmission patterns, size of the note and the magnetic characteristics of the inserted note. The various sensors output sensed data output signals which are compared by a validator processor (not shown) to stored data representative of the range of sensor readings corresponding to authentic notes and determine the denomination.

If the note is determined to be valid and authentic, based on the comparison with the stored data for authentic notes, the transportation unit 30 transports the note to the note box 32 for storage. Also, upon receipt and determination of validity, a signal is sent to the gaming machine's CPU 20 signifying receipt as well as the denomination of the note for accumulation of a like value amount of credits in the gaming machine 10. If the note is not validated, the transportation unit 30 is reversed and the note is ejected through the opening 22 to the customer.

The information accumulated by the validator processor, such as the status of the bill acceptor and denomination of accepted notes, is available to be communicated to and displayed on the indicators on the runway surface 34 and/or display surface 36 of the enhanced bezel 24. The display indicators on the enhanced bezel 24 may be controlled directly by the validator processor, or the enhanced bezel may have its own logic device such as a bezel processor (not shown). The bezel processor may be configured and connected to monitor the communications between the bill validator and the host, or it may receive special signals from the validator processor. The bezel processor determines the state of the validator and/or the host machine, and uses the results to control the visual display indicators.

The bezel processor may monitor the status and activity information provided by the validator processor, and use the results to control the indicators. The bezel processor may alternatively be placed on the controller of the bill validator.

Figure 3:
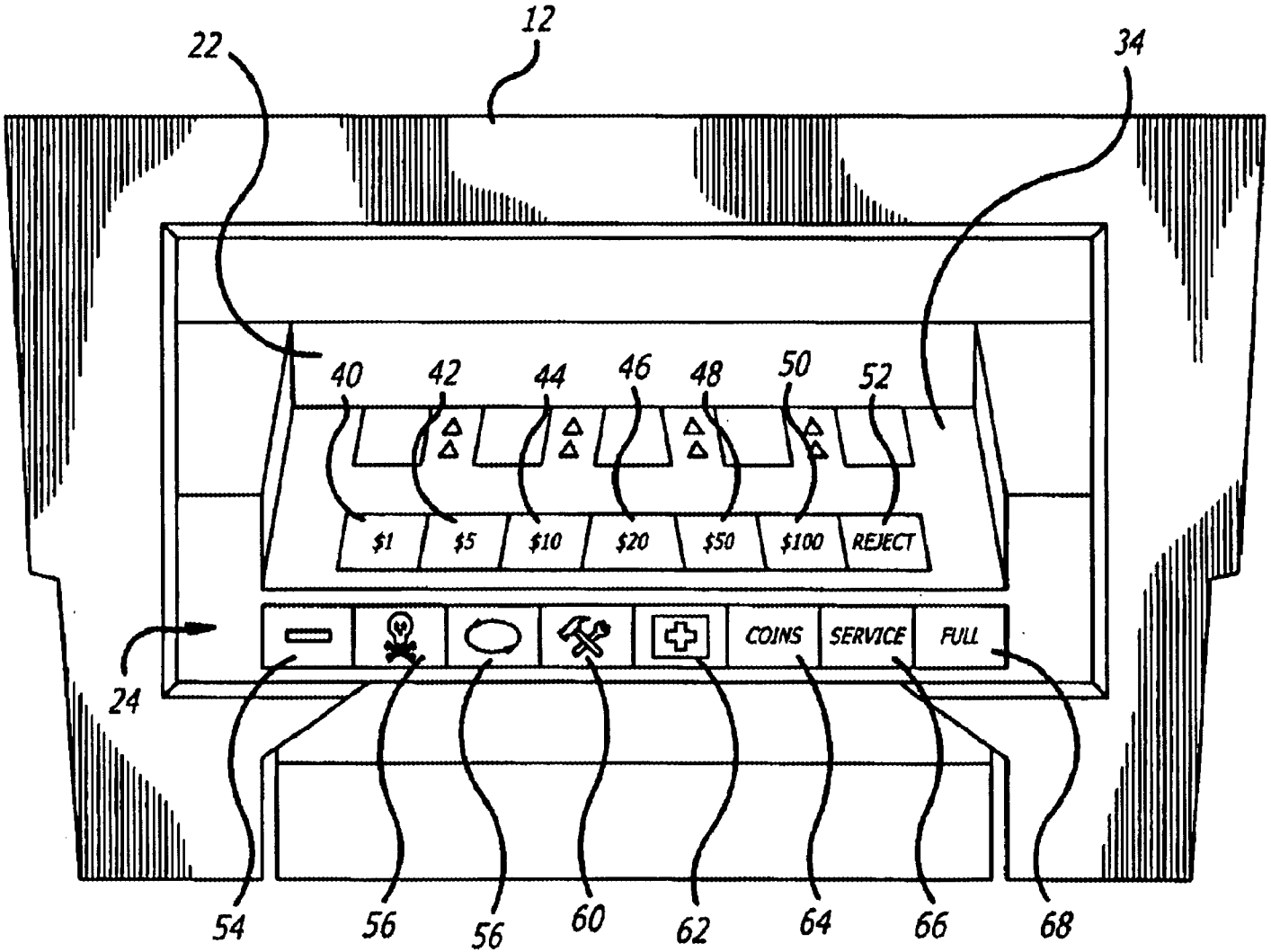
FIG. 3 shows a detailed front view of one version of the enhanced bezel according to the present invention.

As shown in FIG. 3, the enhanced bezel 24 has multiple display indicators on the runway surface 34, including a $1 indicator 40, $5 indicator 42, $10 indicator 44, $20 indicator 46, $50 indicator 48 and $100 indicator 50 which display the denomination of received and accepted notes. In addition, the runway surface may have a "reject" indicator 52, to visually display when an unacceptable bill has been inserted and rejected. Additional indicators located on the display surface 36 of the enhanced bezel may include a system lock indicator 54, counterfeit bill indicator 56, transport jam indicator 58 and service indicator 60. The display surface 36 may also include additional indicators for the host machine, such as a diagnostic indicator 62, coin indicator 64, machine service indicator 66 and validator note box full indicator 68. It should be understood that the various specific display indicators described herein are representative only, and other types of display symbols may be substituted.

For all of the various indicators there are several different methods of displaying the information, for example by back side illumination using, alone or in combination, incandescent lamps, LEDs, electroluminescent emitters, liquid crystals, numeric alphanumeric and graphic displays, and mechanical semaphores. The various indicators are preferably an integral part of a molded or fabricated bill entry piece of the bill acceptor 12. Alternatively, the indicators may be separate from the bill acceptor or be part of an associated display panel placed on a display surface of the host machine.

While the foregoing description and attached Figures define an embodiment of the present invention, it is to be understood that it is subject to many modifications and changes without departing from the spirit and scope of the appended claims.

What is claimed is:

1. A bill acceptor having an opening for inserting a bill, said bill acceptor comprising:

a validator;

a transport assembly to transport bills inserted into said opening through said validator;

a bezel positioned proximate said opening, said bezel including a runway on which said bills are placed for insertion into said bill acceptor, said runway having a display area including a plurality of visual display indicators on said runway, where at least one of said display indicators is at least one of a text indicator and a graphical symbol indicator; and a processor to monitor the status and activity of said validator, said processor being connected to and controlling said display indicators on said runway.

2. The bill acceptor of claim 1, wherein said display indicators on said runway include at least one of a $1 indicator, a $5 indicator, a $10 indicator, a $20 indicator, a $50 indicator and a $100 indicator for visually displaying denominations of valid notes inserted into said bill acceptor upon said runway and accepted by the bill acceptor.

3. The bill acceptor of claim 1, wherein at least one of said display indicators is a reject indicator for visually displaying when an unacceptable bill has been inserted and rejected by said validator.

4. The bill acceptor of claim 1, wherein at least one of said display indicators include at least one of a system lock indicator, a counterfeit bill indicator, a transport jam indicator and a service indicator.

5. The bill acceptor of claim 1, wherein at least one of said display indicators include at least one of a diagnostic indicator, a coin indicator, a machine service indicator and a note box full indicator.

6. The bill acceptor of claim 1, wherein said bezel further comprises a surface vertically mounted at a leading edge of said runway surface so as to form a second display surface for mounting display indicators.

7. The bill acceptor of claim 1, wherein said plurality of display indicators are selected from the group consisting of incandescent lamps, light emitting diodes, electroluminescent emitters, liquid crystals, numeric alphanumeric and graphic displays, and mechanical semaphores.

8. The bill acceptor of claim 1, wherein said processor controls said validator and said display indicators.

9. A method of displaying status and activity information of a bill acceptor comprising:

providing a validator having a processor for accumulating status and activity information;

providing a bezel having a runway surface on which said bills are placed for insertion into said bill acceptor, said runway including a plurality of display indicators, where at least one of said display indicators is at least one of a text indicator and a graphical symbol indicator; and connecting said processor to said plurality of display indicators to control said display indicators and display information received from said validator.

10. The method of claim 9, wherein said information displayed by said display indicators includes denominations of notes inserted and accepted by said bill acceptor.

11. The method of claim 10 including displaying said information by back-side illumination using a device selected from the group consisting of incandescent lamps, light emitting diodes, electroluminescent emitters, liquid crystals, numeric alphanumeric and graphic displays, and mechanical semaphores.

12. The method of claim 9, wherein said information displayed by said display indicators is displayed by a device selected from the group consisting of incandescent lamps, light emitting diodes, electroluminescent emitters, liquid crystals, numeric alphanumeric and graphic displays, and mechanical semaphores.

13. The method of claim 9, wherein said information displayed by said display indicators includes information about the status of said bill validator.

14. A method of displaying status and activity information of a gaming machine on an enhanced bezel comprising:

providing a validator processor in said gaming machine for accumulating said status and activity information;

mounting an enhanced bezel on said validator, said enhanced bezel including a runway surface on which bills are placed for insertion into said validator;

providing multiple display indicators on said runway surface of said enhanced bezel, where at least a portion of said display indicators is denomination of bills;

accepting bills through an opening positioned at a back end of said runway surface of said enhanced bezel; and causing said validator processor to control said display indicators for displaying said information.

15. A bezel for a bill acceptor having an opening for inserting a bill, said bezel comprising:

a runway surface onto which bills are placed for insertion into said bill acceptor;

a display surface having a plurality of visual display indicators on said runway surface, where at least one of said display indicators is at least one of a text indicator and a graphical symbol indicator; and a processor to monitor the status and activity of said validator, said processor being connected to and controlling said display indicators of said bezel.

16. The bezel of claim 15, wherein said display indicators include at least one of a $1 indicator, a $5 indicator, a $10 indicator, a $20 indicator, a $50 indicator and a $100 indicator for visually displaying denominations of valid notes accepted by the bill acceptor.

17. The bezel of claim 15, wherein said bezel further comprises a surface vertically mounted at a leading edge of said runway surface to form a second display surface for mounting display indicators.

18. The bezel of claim 15, wherein said plurality of display indicators are selected from the group consisting of incandescent lamps, light emitting diodes, electroluminescent emitters, liquid crystals, numeric alphanumeric and graphic displays, and mechanical semaphores.

19. The bezel of claim 16, wherein said plurality of display indicators are selected from the group consisting of incandescent lamps, light emitting diodes, electroluminescent emitters, liquid crystals, numeric alphanumeric and graphic displays, and mechanical semaphores.

20. Apparatus for displaying status and activity information of a bill acceptor attached to a host machine, comprising:

a validator having a processor for accumulating status and activity information; and a plurality of display indicators connected to said processor of said validator, where at least one of said display indicators is at least one of a text indicator and a graphical symbol indicator, said processor controlling said display indicators to visually display information received from said validator, wherein at least some of said plurality of display indicators are positioned on a runway surface of [that projects in a substantially horizontal manner from] a bezel leading to a slot into which bills are inserted into said bill acceptor.

21. The apparatus of claim 20, wherein said information displayed by said display indicators includes denominations of notes inserted and accepted by said bill acceptor.

22. The apparatus of claim 20, wherein said information displayed by said display indicators includes information about the status of said bill validator.

23. The apparatus of claim 20, wherein said information displayed by said display indicators is displayed by a device selected from the group consisting of incandescent lamps, light emitting diodes, electroluminescent emitters, liquid crystals, numeric alphanumeric and graphic displays, and mechanical semaphores.

24. The apparatus of claim 20 wherein said display indicators display said information by back-side illumination using a device selected from the group consisting of incandescent lamps, light emitting diodes, electroluminescent emitters, liquid crystals, numeric alphanumeric and graphic displays, and mechanical semaphores.

* * * * *